US009605488B2

(12) United States Patent
Stockey et al.

(10) Patent No.: US 9,605,488 B2
(45) Date of Patent: Mar. 28, 2017

(54) CUTTING ELEMENTS INCLUDING UNDULATING BOUNDARIES BETWEEN CATALYST-CONTAINING AND CATALYST-FREE REGIONS OF POLYCRYSTALLINE SUPERABRASIVE MATERIALS AND RELATED EARTH-BORING TOOLS AND METHODS

(71) Applicant: Baker Hughes Incorporated, Houston, TX (US)

(72) Inventors: David A. Stockey, The Woodlands, TX (US); Anthony A. DiGiovanni, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 319 days.

(21) Appl. No.: 14/248,068

(22) Filed: Apr. 8, 2014

(65) Prior Publication Data

US 2015/0285007 A1 Oct. 8, 2015

(51) Int. Cl.
*E21B 10/573* (2006.01)
*E21B 10/567* (2006.01)
(Continued)

(52) U.S. Cl.
CPC ..... *E21B 10/567* (2013.01); *B24D 99/005* (2013.01); *E21B 10/5735* (2013.01);
(Continued)

(58) Field of Classification Search
CPC ..... E21B 2010/545; E21B 10/55; E21B 2010/565; E21B 10/5735; E21B 10/567
See application file for complete search history.

(56) References Cited

U.S. PATENT DOCUMENTS 4,224,380 A 9/1980 Bovenkerk et al.
5,011,515 A * 4/1991 Frushour ..... B22F 7/06 175/420.2
(Continued)

FOREIGN PATENT DOCUMENTS

AU 2005243867 A1 11/2005
CA 2566597 A1 11/2005
(Continued)

OTHER PUBLICATIONS

Cheng, U.S. Appl. No. 13/947,723, entitled Thermally Stable Polycrystalline Compacts for Reduced Spalling Earth-Boring Tools Including Such Compacts, and Related Methods, filed Jul. 22, 2013.
(Continued)

*Primary Examiner* — Blake Michener
(74) *Attorney, Agent, or Firm* — TraskBritt

(57) ABSTRACT

Cutting elements for earth-boring tools may include a substrate and a polycrystalline superabrasive material secured to the substrate. The polycrystalline superabrasive material may include a first region including catalyst material in interstitial spaces among interbonded grains of the polycrystalline superabrasive material. A second region at least substantially free of catalyst material in the interstitial spaces among the interbonded grains of the polycrystalline superabrasive material may be located adjacent to the first region. An undulating boundary defined between the first region and the second region may extend from a longitudinal axis of the cutting element to a periphery of the cutting element.

20 Claims, 8 Drawing Sheets

(51) Int. Cl.

| | |
|---|---|
| ***B24D 99/00*** | (2010.01) |
| *E21B 10/56* | (2006.01) |
| *C22C 26/00* | (2006.01) |
| *C22C 29/08* | (2006.01) |
| *B22F 5/00* | (2006.01) |

(52) U.S. Cl.

CPC ..... *B22F 2005/005* (2013.01); *C22C 26/00* (2013.01); *C22C 29/08* (2013.01); *C22C 2204/00* (2013.01); *E21B 2010/565* (2013.01)

(56) References Cited

U.S. PATENT DOCUMENTS

| | | | | |
|---|---|---|---|---|
| 5,127,923 | A | 7/1992 | Bunting et al. | |
| 5,172,778 | A * | 12/1992 | Tibbitts | E21B 10/5673 175/420.1 |
| 5,472,376 | A | 12/1995 | Olmstead et al. | |
| 5,605,198 | A | 2/1997 | Tibbitts et al. | |
| 5,669,271 | A | 9/1997 | Griffin et al. | |
| 5,709,279 | A * | 1/1998 | Dennis | E21B 10/5735 175/430 |
| 5,711,702 | A * | 1/1998 | Devlin | B24D 99/00 175/428 |
| 5,787,022 | A | 7/1998 | Tibbitts et al. | |
| 5,829,541 | A * | 11/1998 | Flood | E21B 10/5735 175/426 |
| 5,862,873 | A * | 1/1999 | Matthias | E21B 10/5735 175/432 |
| 5,906,246 | A * | 5/1999 | Mensa-Wilmot | B23B 27/146 175/432 |
| 5,950,747 | A | 9/1999 | Tibbitts et al. | |
| 6,011,232 | A | 1/2000 | Matthias | |
| 6,021,859 | A | 2/2000 | Tibbitts et al. | |
| 6,045,440 | A | 4/2000 | Johnson et al. | |
| 6,193,001 | B1 | 2/2001 | Eyre et al. | |
| 6,202,772 | B1 * | 3/2001 | Eyre | E21B 10/5735 175/432 |
| 6,601,662 | B2 | 8/2003 | Matthias et al. | |
| 6,991,049 | B2 | 1/2006 | Eyre et al. | |
| 7,165,636 | B2 | 1/2007 | Eyre et al. | |
| 7,533,740 | B2 | 5/2009 | Zhang | |
| 7,712,553 | B2 | 5/2010 | Shamburger | |
| 8,172,012 | B2 | 5/2012 | Achilles | |
| 8,197,936 | B2 | 6/2012 | Keshavan | |
| 8,277,722 | B2 | 10/2012 | DiGiovanni | |
| 8,353,371 | B2 | 1/2013 | Cooley et al. | |
| 8,535,400 | B2 | 9/2013 | Belnap et al. | |
| 8,567,531 | B2 | 10/2013 | Belnap et al. | |
| 8,721,752 | B2 | 5/2014 | Fuller et al. | |
| 8,764,864 | B1 | 7/2014 | Miess et al. | |
| 8,783,389 | B2 | 7/2014 | Fan et al. | |
| 8,800,692 | B2 | 8/2014 | Scott et al. | |
| 8,821,604 | B2 | 9/2014 | Sani | |
| 8,839,889 | B2 | 9/2014 | DiGiovanni et al. | |
| 8,899,358 | B2 | 12/2014 | Yu et al. | |
| 8,978,789 | B1 | 3/2015 | Sani et al. | |
| 8,985,248 | B2 | 3/2015 | DiGiovanni et al. | |
| 8,999,025 | B1 | 4/2015 | Miess et al. | |
| 9,103,172 | B1 | 8/2015 | Bertagnolli et al. | |
| 9,316,059 | B1 | 4/2016 | Topham et al. | |
| 2001/0003932 | A1 * | 6/2001 | Packer | E21B 10/567 76/108.2 |
| 2002/0071729 | A1 * | 6/2002 | Middlemiss | B23C 5/202 407/114 |
| 2002/0074168 | A1 | 6/2002 | Matthias et al. | |
| 2002/0079140 | A1 | 6/2002 | Eyre et al. | |
| 2003/0037964 | A1 | 2/2003 | Sinor et al. | |
| 2003/0079918 | A1 * | 5/2003 | Eyre | E21B 10/5735 175/432 |
| 2006/0165993 | A1 * | 7/2006 | Keshavan | B24D 18/0009 428/408 |
| 2007/0039762 | A1 | 2/2007 | Achilles | |
| 2007/0144790 | A1 | 6/2007 | Fang et al. | |
| 2008/0206576 | A1 * | 8/2008 | Qian | B24D 3/10 428/446 |
| 2009/0022952 | A1 | 1/2009 | Keshavan | |
| 2010/0012389 | A1 * | 1/2010 | Zhang | B24D 99/005 175/432 |
| 2010/0186304 | A1 | 7/2010 | Burgess et al. | |
| 2010/0236837 | A1 | 9/2010 | Achilles | |
| 2010/0242375 | A1 | 9/2010 | Hall et al. | |
| 2010/0288564 | A1 | 11/2010 | Dovalina et al. | |
| 2010/0320006 | A1 | 12/2010 | Fan et al. | |
| 2011/0042149 | A1 | 2/2011 | Scott et al. | |
| 2011/0088950 | A1 | 4/2011 | Scott et al. | |
| 2011/0120782 | A1 | 5/2011 | Cooley et al. | |
| 2011/0171414 | A1 | 7/2011 | Sreshta et al. | |
| 2011/0174549 | A1 | 7/2011 | Dolan et al. | |
| 2011/0212303 | A1 | 9/2011 | Fuller et al. | |
| 2011/0259642 | A1 | 10/2011 | DiGiovanni et al. | |
| 2011/0259648 | A1 | 10/2011 | Sani | |
| 2011/0266059 | A1 | 11/2011 | DiGiovanni et al. | |
| 2012/0037431 | A1 | 2/2012 | DiGiovanni et al. | |
| 2012/0080239 | A1 | 4/2012 | Lyons et al. | |
| 2012/0097457 | A1 | 4/2012 | Setlur et al. | |
| 2012/0103700 | A1 | 5/2012 | Lin | |
| 2012/0222363 | A1 | 9/2012 | DiGiovanni et al. | |
| 2012/0222364 | A1 | 9/2012 | Lyons et al. | |
| 2012/0225277 | A1 | 9/2012 | Scott | |
| 2013/0068534 | A1 | 3/2013 | DiGiovanni et al. | |
| 2013/0068537 | A1 | 3/2013 | DiGiovanni | |
| 2013/0068538 | A1 | 3/2013 | DiGiovanni et al. | |
| 2013/0092454 | A1 | 4/2013 | Scott et al. | |
| 2013/0292184 | A1 | 11/2013 | Weaver | |
| 2014/0060937 | A1 | 3/2014 | Konovalov et al. | |
| 2014/0069726 | A1 | 3/2014 | Mumma et al. | |
| 2014/0134403 | A1 | 5/2014 | Gledhill | |
| 2014/0166371 | A1 | 6/2014 | Whittaker | |
| 2015/0021100 | A1 | 1/2015 | Cheng | |
| 2015/0129321 | A1 | 5/2015 | Sani | |
| 2015/0259986 | A1 | 9/2015 | Stockey | |
| 2015/0266163 | A1 | 9/2015 | Stockey et al. | |
| 2016/0002982 | A1 | 1/2016 | Mukhopadhyay et al. | |
| 2016/0230471 | A1 | 8/2016 | Gonzalez et al. | |
| 2016/0318808 | A1 | 11/2016 | Kasonde et al. | |
| 2016/0325404 | A1 | 11/2016 | Long et al. | |
| 2016/0326809 | A1 | 11/2016 | Long et al. | |
| 2016/0339561 | A1 | 11/2016 | Vail | |

FOREIGN PATENT DOCUMENTS

| | | | |
|---|---|---|---|
| CA | 2566597 | C | 11/2011 |
| EP | 1750876 | B1 | 7/2011 |
| WO | 2005110648 | A2 | 11/2005 |
| WO | 2009024752 | A2 | 2/2009 |
| WO | 2012145586 | A1 | 10/2012 |

OTHER PUBLICATIONS

Scott et al., U.S. Appl. No. 13/783,118, entitled Cutting Elements Leached to Different Depths Located in Different Regions of an Earth-Boring Tool and Related Methods, filed Mar. 1, 2013.

Underwood, Ervin E., Quantitative Stereology, Addison-Wesley Publishing Company, Inc., 1970, 20 pages.

DiGiovanni et al., U.S. Appl. No. 141248,008, entitled Cutting Elements Having a Non-Uniform Annulus Leach Depth, Earth-Boring Tools Including Such Cutting Elements, and Related Methods, filed Apr. 8, 2014.

Stockey et al., U.S. Appl. No. 14/329,380, entitled Cutting Elements Comprising Partially Leached Polycrystalline Material, Tools Comprising Such Cutting Elements, and Methods of Forming Wellbores Using Such Cutting Elements, filed Jul. 11, 2014.

Stockey, David A., U.S. Appl. No. 14/215,786, entitled Cutting Elements Having Non-Planar Cutting Faces With Selectively Leached Regions, Earth-Boring Tools Including Such Cutting Elements, and Related Methods, filed Mar. 17, 2014.

* cited by examiner

CUTTING ELEMENTS INCLUDING UNDULATING BOUNDARIES BETWEEN CATALYST-CONTAINING AND CATALYST-FREE REGIONS OF POLYCRYSTALLINE SUPERABRASIVE MATERIALS AND RELATED EARTH-BORING TOOLS AND METHODS

FIELD

This disclosure relates generally to cutting elements for earth-boring tools. More specifically, disclosed embodiments relate to polycrystalline superabrasive materials for use in cutting elements for earth-boring tools, which polycrystalline superabrasive materials may have catalyst materials removed from one or more selected regions of the polycrystalline superabrasive materials.

BACKGROUND

Earth-boring tools for forming wellbores in subterranean earth formations may include cutting elements secured to a body. For example, fixed-cutter, earth-boring rotary drill bits (also referred to as "drag bits") include cutting elements that are fixedly attached to a body of the drill bit. Similarly, roller cone earth-boring rotary drill bits include cones that are mounted on bearing pins extending from legs of a body such that each cone is capable of rotating about the bearing pin on which it is mounted. Cutting elements may be mounted to each cone of the drill bit.

The cutting elements used in such earth-boring tools are often polycrystalline diamond compact (often referred to as "PDC") cutting elements, also termed "cutters." PDC cutting elements include a polycrystalline diamond (PCD) material, which may be characterized as a superabrasive or superhard material. Such polycrystalline diamond materials are formed by sintering and bonding together small diamond grains (e.g., diamond crystals), termed "grit," under conditions of high temperature and high pressure in the presence of a catalyst material to form a polycrystalline diamond material. The polycrystalline diamond material is frequently in the shape of a disc, also called a "diamond table." The processes used to form polycrystalline diamond material are often referred to as high temperature/high pressure ("HTHP") processes.

PDC cutting elements also frequently feature a substrate to which the polycrystalline diamond compact is secured. The cutting element substrate may be formed of a ceramic-metallic composite material (i.e., a cermet), such as, for example, cobalt-cemented tungsten carbide. In some instances, the polycrystalline diamond table may be formed on the substrate, for example, during the HTHP sintering process. In such instances, cobalt or other metal solvent catalyst material in the cutting element substrate (e.g., a metal matrix of the ceramic-metallic composite material) may be swept among the diamond grains during sintering and serve as a catalyst material for forming a diamond table from the diamond grains. Powdered catalyst material may also be mixed with the diamond grains prior to sintering the grains together in an HTHP process. In other methods, however, the diamond table may be formed separately from the cutting element substrate and subsequently attached thereto.

To reduce problems associated with differences in thermal expansion and chemical breakdown of the diamond crystals in PDC cutting elements, "thermally stable" polycrystalline diamond compacts (which are also known as thermally stable products or "TSPs") have been developed. Such a thermally stable polycrystalline diamond compact may be formed by removing catalyst material out from interstitial spaces among the interbonded grains in the diamond table (e.g., by leaching the catalyst material from the diamond table using a corrosive material, such as an acid). Diamond tables that have been at least substantially fully leached are relatively more brittle and vulnerable to shear, compressive, and tensile stresses than are unleached diamond tables. In addition, it may be difficult to secure a completely leached diamond table to a supporting substrate. To provide cutting elements having diamond tables that are more thermally stable relative to unleached diamond tables, but that are also relatively less brittle and vulnerable to shear, compressive, and tensile stresses than fully leached diamond tables, cutting elements have been provided that include a diamond table in which the catalyst material has been leached from only a portion or portions of the diamond table. For example, it is known to leach catalyst material from the cutting face, from the side of the diamond table, or both, to a desired depth within the diamond table, but without leaching all of the catalyst material out from the diamond table.

BRIEF SUMMARY

In some embodiments, cutting elements for earth-boring tools may include a substrate and a polycrystalline superabrasive material secured to the substrate. The polycrystalline superabrasive material may include a first region including catalyst material in interstitial spaces among interbonded grains of the polycrystalline superabrasive material. A second region at least substantially free of catalyst material in the interstitial spaces among the interbonded grains of the polycrystalline superabrasive material may be located adjacent to the first region. An undulating boundary defined between the first region and the second region may extend from a longitudinal axis of the cutting element to a periphery of the cutting element.

In other embodiments, earth-boring tools may include a body and a cutting element secured to the body. The cutting element may include a substrate secured to the body and a polycrystalline superabrasive material secured to the substrate. The polycrystalline superabrasive material may include a first region including catalyst material in interstitial spaces among interbonded grains of the polycrystalline superabrasive material. A second region at least substantially free of catalyst material in the interstitial spaces among the interbonded grains of the polycrystalline superabrasive material may be located adjacent to the first region. An undulating boundary defined between the first region and the second region may extend from a longitudinal axis of the cutting element to a periphery of the cutting element.

In still other embodiments, methods of preparing cutting elements for earth-boring tools may involve retaining catalyst material within interstitial spaces among interbonded grains in a first region of a polycrystalline superabrasive material. The polycrystalline superabrasive material may be secured to a substrate. Catalyst material may be at least substantially completely removed from interstitial spaces among interbonded grains in a second region of the polycrystalline superabrasive material. An undulating boundary defined between the first region and the second region may extend from a longitudinal axis of the cutting element to a periphery of the cutting element.

BRIEF DESCRIPTION OF THE DRAWINGS

While this disclosure concludes with claims particularly pointing out and distinctly claiming specific embodiments, various features and advantages of embodiments within the scope of this disclosure may be more readily ascertained from the following description when read in conjunction with the accompanying drawings, in which:

DETAILED DESCRIPTION

Figure 1:
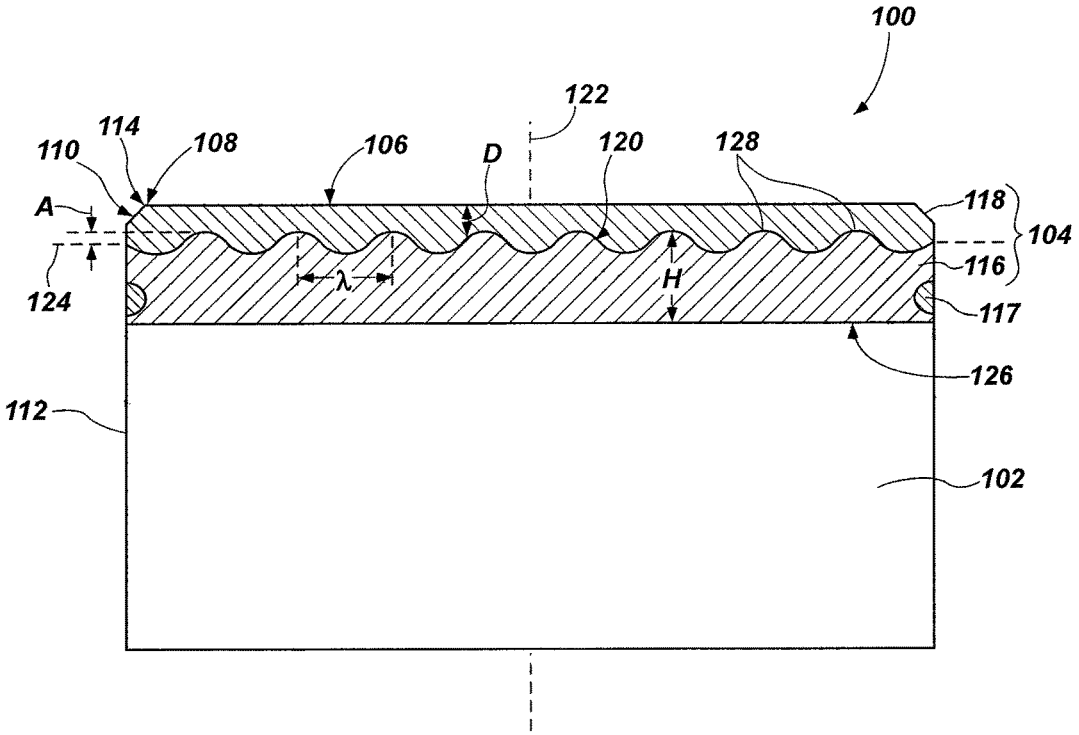
FIG. 1 is a cross-sectional view of a cutting element.

The illustrations presented in this disclosure are not meant to be actual views of any particular earth-boring tool, cutting element, polycrystalline superabrasive material, or component thereof, but are merely idealized representations employed to describe illustrative embodiments. Thus, the drawings are not necessarily to scale.

Disclosed embodiments relate generally to polycrystalline superabrasive materials that may have catalyst materials removed from selected regions of the polycrystalline superabrasive materials. More specifically, disclosed are embodiments of polycrystalline superabrasive materials that may have catalyst materials removed to differing depths from a surface of a mass of superabrasive materials at laterally different locations spaced from the surface to define a tortuous, undulating boundary between catalyst-containing regions and catalyst-free regions of the polycrystalline superabrasive materials and induce compressive residual stresses in certain regions of the polycrystalline superabrasive materials, which may suppress, interrupt, or otherwise reduce crack formation and propagation within the polycrystalline superabrasive materials.

The terms "earth-boring tool" and "earth-boring drill bit," as used in this disclosure, mean and include any type of bit or tool used for drilling during the formation or enlargement of a wellbore in a subterranean formation and include, for example, fixed-cutter bits, roller cone bits, percussion bits, core bits, eccentric bits, bicenter bits, reamers, mills, drag bits, hybrid bits, and other drilling bits and tools known in the art.

As used in this disclosure, the term "superabrasive material" means and includes any material having a Knoop hardness value of about 3,000 $Kg/mm^2$ (~29,420 MPa) or more. Superabrasive materials include, for example, diamond and cubic boron nitride. Superabrasive materials may also be characterized as "superhard" materials.

As used in this disclosure, the term "polycrystalline material" means and includes any material including grains (i.e., crystals) of material that are bonded directly together by intergranular bonds. The crystal structures of the individual gains of the material may be randomly oriented in space within the polycrystalline material.

As used in this disclosure, the terms "intergranular bond" and "interbonded" mean and include any direct atomic bond (e.g., covalent, ionic, metallic, etc.) between atoms in adjacent grains of superabrasive material.

The term "sintering" as used in this disclosure means temperature driven mass transport, which may include densification and/or coalescing of a particulate component, and typically involves removal of at least a portion of the pores between the starting particles (accompanied by shrinkage) combined with coalescence and bonding between adjacent particles.

As used herein, the term "catalyst material" refers to any material that is capable of catalyzing the formation of intergranular diamond-to-diamond bonds in a diamond grit or powder during an HTHP process in the manufacture of polycrystalline diamond. By way of example, metal solvent catalyst materials include elements from Group VIIIB of the Periodic Table of the Elements, such as cobalt, iron, nickel, and alloys and mixtures thereof, even when alloyed or mixed with other, noncatalyzing materials.

As used in this disclosure, the term "tungsten carbide" means any material composition that contains chemical compounds of tungsten and carbon, such as, for example, WC, $W_2C$, and combinations of WC and $W_2C$. Tungsten carbide includes, for example, cast tungsten carbide, sintered tungsten carbide, and macrocrystalline tungsten carbide.

As used in this disclosure, the terms "at least substantially free of catalyst material," "free of catalyst material," and "catalyst-free" mean catalyst material has been removed to commercial purity. For example, a volume of material may be at least substantially free of catalyst material even though residual catalyst material may adhere to other materials (e.g., to the surfaces of interbonded grains of a superabrasive polycrystalline material) in the volume and isolated volumes of catalyst material may remain in interstitial spaces that are inaccessible by leaching (e.g., because they are closed off by interbonded grains of a superabrasive polycrystalline material and not connected to an otherwise continuous, open network of interstitial spaces among the interbonded grains).

Referring to FIG. 1, a cross-sectional view of a cutting element 100 is shown. The cutting element may include a substrate 102 and a polycrystalline superabrasive material 104 secured to the substrate 102. The cutting element 100 may exhibit an at least substantially cylindrical shape. For example, the substrate 102 may be at least substantially cylindrical and the polycrystalline superabrasive material 104 may be at least substantially disc-shaped. The polycrystalline superabrasive material 104 may define a cutting face 106, which may be an exposed major surface of the superabrasive material 104 oriented to rotationally lead and engage with an underlying earth formation. A cutting edge 108 may be located at a periphery of the cutting face 106. For example, the cutting edge 108 may be defined by an intersection between the cutting face 106 and a beveled surface 110, which may extend between the cutting face 106 and a side surface 112 of the cutting element 100. A cutting point 114 may be located on the cutting edge 108 at a location of intended engagement with an underlying earth formation.

Each of the substrate 102 and the polycrystalline superabrasive material 104 may be formed from materials suitable for use in a downhole drilling environment, which may involve subjecting the materials to elevated temperatures and pressures, corrosive materials, impact forces, and abrasive and erosive wear. For example, the substrate 102 may be formed from a ceramic-metallic composite material (i.e., a cermet). More specifically, the substrate 102 may be formed from a ceramic-metallic composite material composed of ceramic particles bound in a metallic matrix. As a specific, nonlimiting example, the substrate 102 may be formed from a cobalt-cemented tungsten carbide material.

In some embodiments, the metallic matrix of the substrate 102 may act as a metal solvent catalyst when forming the polycrystalline superabrasive material 104. For example, the metallic matrix material of the substrate 102 may liquefy under during a high-temperature, high-pressure process, may be swept in among grains of superabrasive material, and may catalyze their growth and interbonding to form the polycrystalline superabrasive material 104.

The polycrystalline superabrasive material 104 may include grains of a superabrasive material that have been interbonded to one another to form an interconnected, polycrystalline matrix of the superabrasive material and network of interconnected interstitial spaces among the interbonded grains of the superabrasive material. For example, grains of a superabrasive material may be sintered in the presence of a catalyst material under high-temperature and high-pressure conditions to produce the polycrystalline superabrasive material 104, in what is frequently referred to as a high-temperature/high-pressure (HTHP) process. As a specific, nonlimiting example, the polycrystalline superabrasive material 104 may be a polycrystalline diamond compact secured to a cobalt-cemented tungsten carbide substrate 102.

A first region 116 of the polycrystalline superabrasive material 104 may include catalyst material in interstitial spaces among interbonded grains of the polycrystalline superabrasive material 104. The first region 116 may be located proximate the substrate 102. For example, a continuous network of catalyst material may form the matrix of the ceramic-metallic composite material of the substrate 102. The catalyst material may occupy the interstitial spaces in the first region 116, such that the continuous network of catalyst material may secure the polycrystalline superabrasive material 104 to the substrate 102.

A second region 118 of the polycrystalline superabrasive material 104 may be at least substantially free of catalyst material in the interstitial spaces among the interbonded grains of the polycrystalline superabrasive material 104. The second region 118 may be adjacent to the first region 116, and at least a portion of the second region 118 may be located on a side of the first region 116 opposing the substrate 102. For example, the second region 118 may extend from the cutting face 106 of the cutting element 100 to the first region 116. In some embodiments, the second region 118 may further extend from a periphery of the polycrystalline superabrasive material 104 radially inwardly to define an annular region 117 at least substantially free of catalyst material at the periphery of the polycrystalline superabrasive material 104. For example, the annular portion 117 of the second region 118 may be formed and shaped at least substantially as described in U.S. patent application Ser. No. 14/248,008, filed on the same date as this application, and titled "CUTTING ELEMENTS HAVING A NON-UNIFORM ANNULUS LEACH DEPTH, EARTH-BORING TOOLS INCLUDING SUCH CUTTING ELEMENTS, AND RELATED METHODS," the disclosure of which is incorporated into this application in its entirety by this reference. Briefly, an interface between an catalyst-containing first region 116 and a catalyst-free annular second region 117 located along the lateral side surface 112 of the cutting element 100 may exhibit a nonlinear profile, which may lead to further reduced fracture and spalling, and increased useable lifetimes relative to previously known cutting elements.

An undulating boundary 120 may be defined between at least a portion of the first region 116 and a corresponding portion of the second region 118. When it is said that the boundary 120 is "undulating," what is meant is that the boundary 120 exhibits significant, repeated variations, which may be uniform in or nonuniform, in depth of removal with respect to the nearest outer reference surface, such as, for example, the cutting face 106. In other words, a depth D of catalyst removal with respect to the cutting face 106 may vary from greater to lesser or lesser to greater and back again as distance from a longitudinal axis 122 (e.g., an axis of rotational symmetry or an axis defined by an average centerline) of the cutting element 100 increases. The undulating boundary 120 may define a nonlinear, tortuous, serpentine, oscillating pathway, which may suppress, interrupt, or otherwise reduce crack formation and propagation within the polycrystalline superabrasive material 104. For example, the undulating boundary 120 may reduce (e.g., eliminate) the likelihood that a crack will propagate for a significant distance along the undulating boundary 120 (e.g., across the entire boundary 120) between the first region 116 and the second region 118, which may otherwise result in chipping and spalling of the polycrystalline superabrasive material 104 and premature failure of the cutting element 100. The undulating boundary 120 may extend, for example, from the longitudinal axis 122 to the periphery of the cutting element 100 within the polycrystalline superabrasive material 104. For example, the entire interface between the first region 116 and the second region 118 may be defined by the undulating boundary 120. In other example embodiments, only a portion of the interface between the first region 116 and the second region 118 may be defined by an undulating boundary, and another portion of the boundary may not undulate (e.g., may be planar or may be curved without undulating).

In some embodiments, a plane 124 defined by an average height H of the undulating boundary 120 with respect to a planar surface 126 of the substrate 102 adjacent to the polycrystalline superabrasive material 104 may be at least substantially parallel to the planar surface 126 of the substrate 102 adjacent to the polycrystalline superabrasive material 104. For example, at least one cross-sectional shape of the undulating boundary 120 may be sinusoidal, as shown in FIG. 1. In some embodiments, a minimum height H of the of the undulating boundary 120 with respect to the planar surface 126 may be greater than zero, such that the second region 118 and the substrate 102 are not adjacent to one another. In other words, the first region 116 may be located between the second region 118 and the substrate 102 in all locations from the longitudinal axis 122 to the periphery of the cutting element 100. In other embodiments, the minimum height H of the undulating boundary 120 with respect to the planar surface 126 may be greater than zero, such that the second region 118 and the substrate 102 are not adjacent to one another. In other words, the first region 116 may be located between the second region 118 and the substrate 102 in all locations from the longitudinal axis 122 to the periphery of the cutting element 100.

In some embodiments, an average amplitude A of crests 128 (e.g., peaks) of the undulating boundary 120 with respect to the plane 124 defined by the average height H of the undulating boundary 120 with respect to the planar surface 126 of the substrate 102 adjacent to the polycrystalline superabrasive material 104 may be, for example, about 50 μm or less, and an average wavelength λ of waves of the undulating boundary 120 may be, for example, about 1,000 μm or less. More specifically, the average amplitude A of crests 128 of the undulating boundary 120 with respect to the plane 124 may be, for example, about 40 μm or less, and the average wavelength λ of waves of the undulating boundary 120 may be, for example, about 300 μm or less. As specific, nonlimiting examples, the average amplitude A of crests 128 of the undulating boundary 120 with respect to the plane 124 may be, for example, about 40 μm or less, and the average wavelength λ of waves of the undulating boundary 120 may be, for example, about 100 μm or less.

In some embodiments, the average amplitude A of the crests 128 of the undulating boundary 120 may be, for example, greater than about one-tenth of a minimum depth D of catalyst removal in the second region 118 (i.e., a smallest distance between a crest 128 and the cutting face 106. More specifically, the average amplitude A of the crests 128 may be, for example, greater than about one-fifth of the minimum depth D of catalyst removal in the second region 118. As a specific, nonlimiting example, the average amplitude A of the crests 128 may be greater than about one-half of the minimum depth D of catalyst removal in the second region 118.

In some embodiments, the undulating boundary 120 may be at or near a crest 128 at the periphery of the cutting element 100. For example, the height H of the undulating boundary 120 above the planar surface 126 of the substrate 102 to which the polycrystalline superabrasive material 104 is adjacent may be greater than the average height H of the undulating boundary 120, as reflected by the plane 124 defined by the average height H of the undulating boundary 120 with respect to the planar surface 126 of the substrate 102 adjacent to the polycrystalline superabrasive material 104.

Of course, if the cutting face 106 is planar or comprises a substantially planar portion, the varying depths of the undulating boundary 120 from the cutting face 106 may be formed with reference to the cutting face 106 itself or the substantially planar portion. Similarly, if the cutting face or a portion thereof is arcuate, for example convex or concave, the varying depths of the undulating boundary from the cutting face 106 may be formed with reference to the arcuate cutting face surface or portion.

In some embodiments, the undulating boundary 120 may be at least substantially free of planar portions along which cracks may propagate. For example, a slope S of the undulating boundary 120 defined by a line tangent to the undulating boundary 120 at a given point may change as distance from the longitudinal axis 122 of the cutting element 100 increases. More specifically, the slope S at each first point $P_1$ defined by the undulating boundary 120 may be different from the slope S at each adjacent point $P_2$ defined by the undulating boundary 120, each adjacent point $P_2$ being located about one-fourth of an average wavelength λ or less from each first point $P_1$. As a specific, nonlimiting example, the slope S of the undulating boundary 120 may be at least substantially constantly changing such that the undulating boundary 120 is composed of arcuate surfaces.

Figure 2:
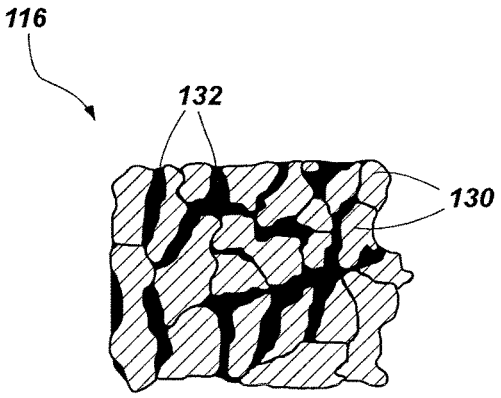
FIG. 2 is an enlarged view of how a microstructure of a first region of a polycrystalline superabrasive material of the cutting element of FIG. 1 may appear under magnification.

FIG. 2 is an enlarged view of how a microstructure of the first region 116 of the polycrystalline superabrasive material 104 of the cutting element 100 of FIG. 1 may appear under magnification. The first region 116 may include grains 130 of superabrasive material that are directly together by intergranular, grain-to-grain bonds to form the polycrystalline matrix of the superabrasive material. The first region 116 may further include catalyst material 132 occupying the network of interstitial spaces among the interbonded grains 130 of superabrasive material.

Figure 3:
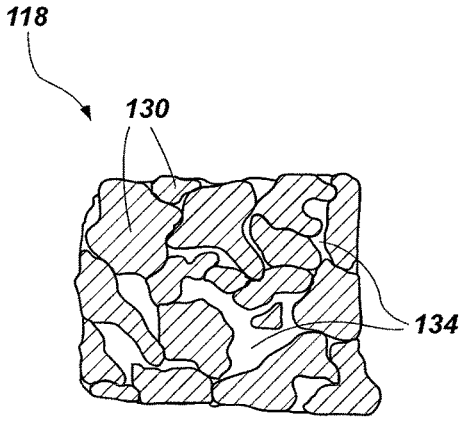
FIG. 3 is an enlarged view of how a microstructure of a second region of the polycrystalline superabrasive material of the cutting element of FIG. 1 may appear under magnification.

FIG. 3 is an enlarged view of how a microstructure of the second region 118 of the polycrystalline superabrasive material 104 of the cutting element 100 of FIG. 1 may appear under magnification. Like the first region 116 (see FIG. 2), the second region 118 may also include grains 130 of superabrasive material that are bonded directly together by intergranular, grain-to-grain bonds to form the polycrystalline matrix of the superabrasive material. Unlike the first region 116 (see FIG. 2), however, the network of interstitial spaces 134 among the interbonded grains 130 of superabrasive material in the second region 118 may be at least substantially free of catalyst material. For example, the interstitial spaces 134 in the second region 118 may be voids (i.e., they may be filled with whatever environmental fluids are capable of permeating the interstitial spaces 134, such as, for example, air). As another example, the interstitial spaces 134 in the second region 118 may be occupied by a non-catalyst material (i.e., a material that is not a catalyst material, as that term is used herein).

As can be seen in FIGS. 2 and 3, removing the catalyst material 132 from the interstitial spaces to a specified depth within the polycrystalline superabrasive material 104 (see FIG. 1) may result in the surfaces being defined by the catalyst material 132 being tortuous because the grains 130 of superabrasive material interrupt what would be an otherwise smooth surface of the catalyst material 132. Accordingly, when it is said that the boundary between the first region 116 and the second region 118 may be an "undulating" boundary 120 (see FIG. 1), what is meant is that a hypothetical, smooth boundary that would be defined by the surface of the catalyst material 132 in the absence of the grains 130 undulates, oscillates, or is otherwise nonplanar.

Figure 4:
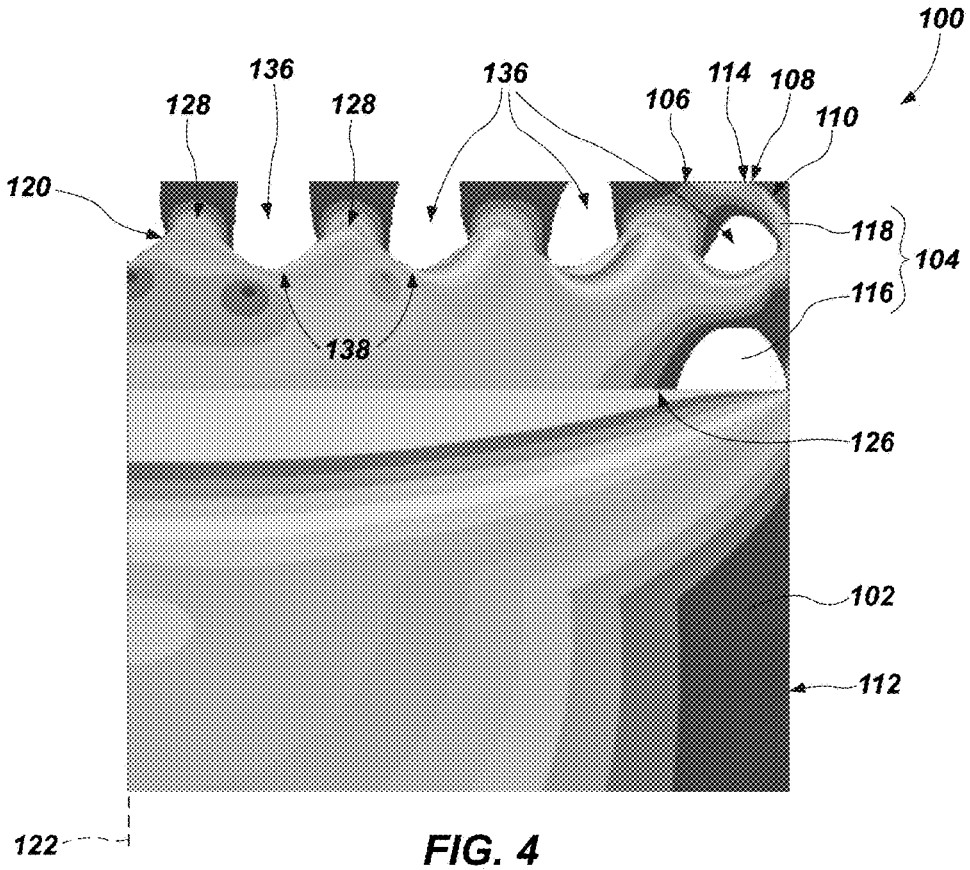
FIG. 4 is a partial cut-away cross-sectional view of a residual stress analysis of the cutting element of FIG. 1.

FIG. 4 is a cross-sectional view of a residual stress analysis of the cutting element 100 of FIG. 1. A compressive residual stress may be induced in one or more portions 136 of the polycrystalline superabrasive material 104 in the second region 118. For example, the shape of the undulating boundary 120 may induce compressive residual stress in several separate, distinct portions 136 of the polycrystalline superabrasive material 104 in the second region 118. More specifically, the portions 136 of the polycrystalline superabrasive material 104 in the second region 118 in which the residual stress is induced may be located between crests 128 of the undulating boundary 120. As a specific, nonlimiting example, the portions 136 of the polycrystalline superabrasive material 104 in the second region 118 in which the residual stress is induced may be located in troughs 138 of the undulating boundary 120. Cracks may be less likely to form within and propagate through the polycrystalline superabrasive material 104 when the polycrystalline superabrasive material 104 is in a state of compressive stress, as compared to when the polycrystalline superabrasive material 104 is not stressed or in a state of tensile stress. The geometry of the undulating boundary 120 between the catalyst-containing first region 116 and the catalyst-free second region 118 of the polycrystalline superabrasive material 104 of the cutting element 100 may lead to reduced fracture and spalling, and increased useable lifetimes relative to previously known cutting elements.

Figure 5:
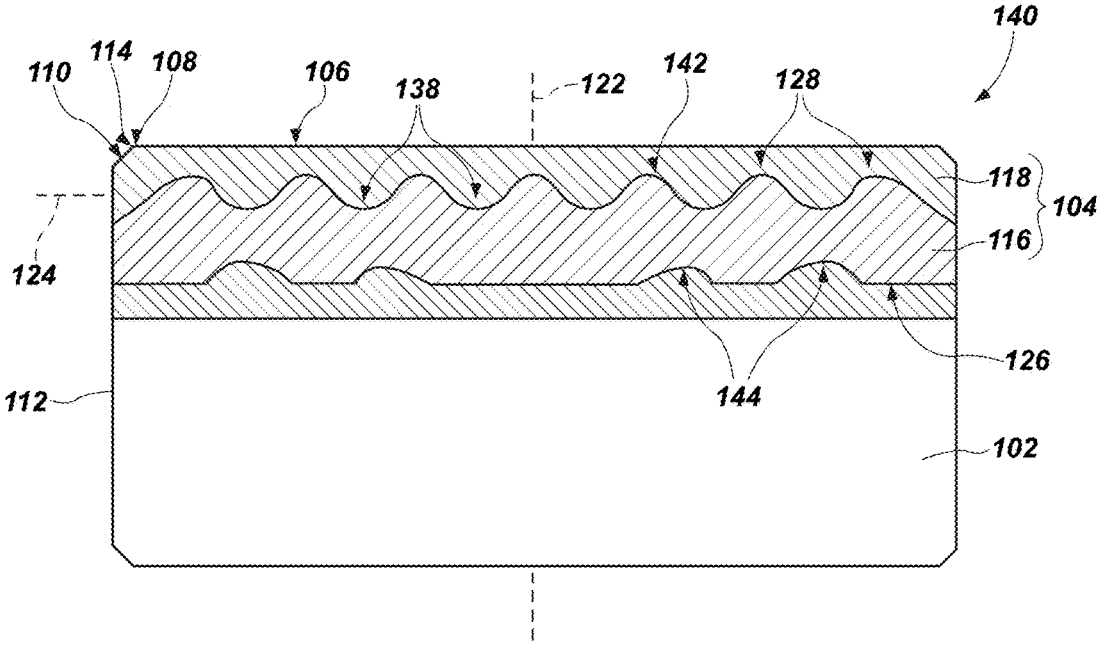
FIG. 5 is a cross-sectional view of another embodiment of a cutting element.

Referring to FIG. 5, a cross-sectional view of another embodiment of a cutting element 140 is shown. In some embodiments, the cutting element 140 may include nonplanar interface features 144 at the interface between the substrate 102 and the polycrystalline superabrasive material 104. For example, a portion of the surface of the substrate 102 contacted by the polycrystalline superabrasive material 104 may be a planar surface 126 and another portion of the surface of the substrate 102 contacted by the polycrystalline superabrasive material 104 may include protrusions or otherwise be nonplanar to define the nonplanar interface features 144. In some embodiments employing a substrate 104 having a partial planar surface 126 or no planar surface 126 on a substrate 102 contacting the polycrystalline superabrasive material 104, the undulating boundary 142 may also be characterized as varying in distance from a plane of such a surface, such plane being a plane perpendicular to the longitudinal axis 122 of the cutting element and extending through at least portions of the interface between the surface of the substrate 102 and the polycrystalline superabrasive material 104.

In some embodiments, the undulating boundary 142 may be at or near a trough 138 at the periphery of the cutting element 140. For example, the height H of the undulating boundary 142 above the planar surface 126 of the substrate 102 at the periphery of the cutting element 140 may be less than the average height H of the undulating boundary 142, as reflected by the plane 124 defined by the average height H of the undulating boundary 142. In such embodiments, the undulating boundary 142 may be phase-shifted with respect to other embodiments in which the undulating boundary 120 (see FIGS. 1, 4) may be at or near a crest 128 at the periphery of the cutting element 100 (see FIGS. 1, 4). In other embodiments, the undulating boundary may be between a crest 128 and a trough 138 at the periphery of the cutting element. For example, the height H of the undulating boundary above the planar surface 126 of the substrate 102 at the periphery of the cutting element 140 may be at least substantially equal to the average height H of the undulating boundary 142, as reflected by the plane 124 defined by the average height H of the undulating boundary 142. In still other embodiments, the undulating boundary may exhibit other geometrical shapes, which may represent deviations from a sinusoidal wave other than a phase shift.

Figure 6:
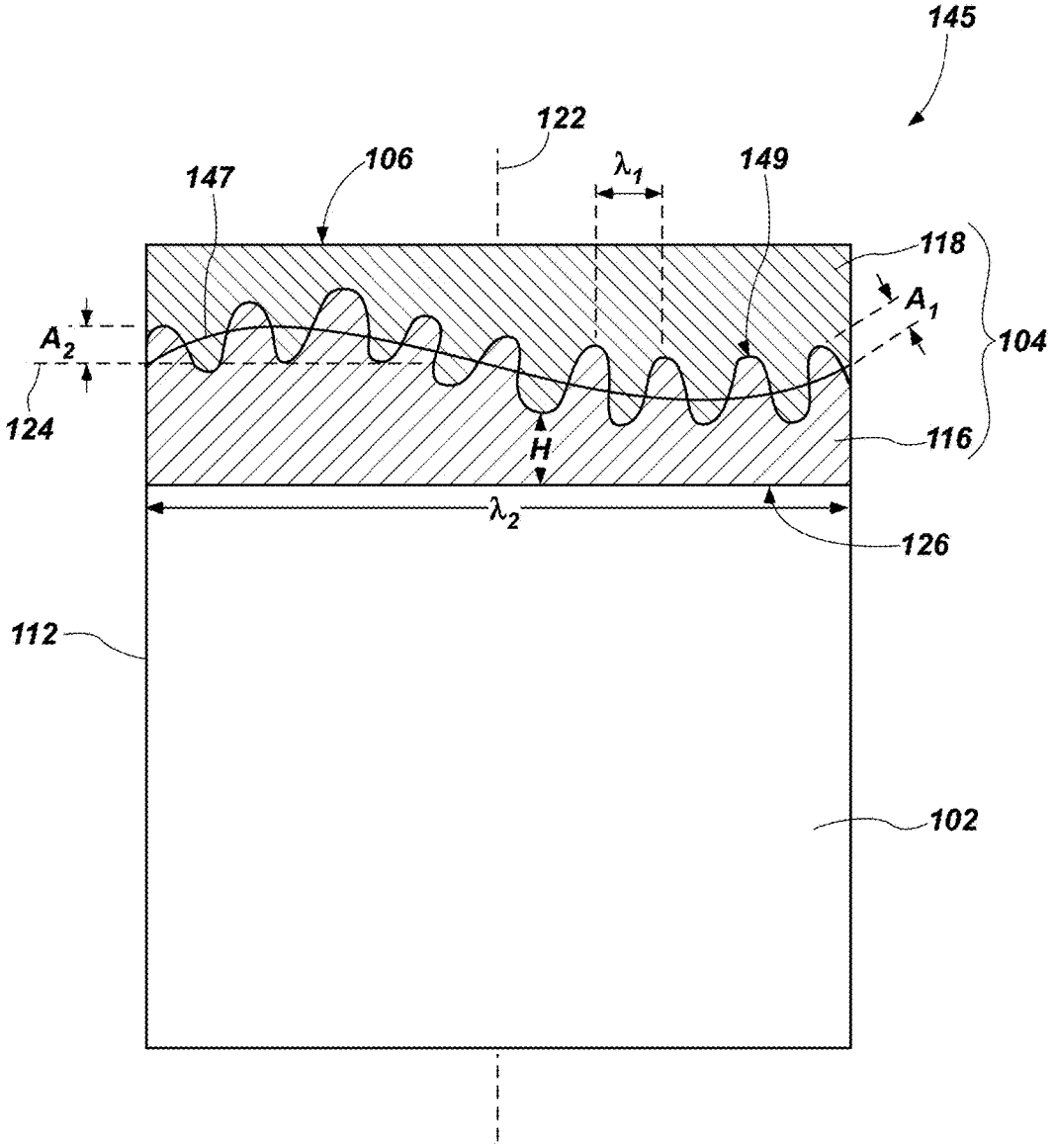
FIG. 6 is a cross-sectional view of yet another embodiment of a cutting element.

FIG. 6 is a cross-sectional view of yet another embodiment of a cutting element 145. In some embodiments, a peak-to-peak centerline 147 of an undulating boundary 149 may also undulate. For example, an average wavelength $\lambda_2$ of the peak-to-peak centerline 147 may be greater than the average wavelength $\lambda_1$ of the undulating boundary 149. More specifically, the average wavelength $\lambda_2$ of the peak-to-peak centerline 147 may be, for example, at least about five times greater than the average wavelength $\lambda_1$ of the undulating boundary 149. As a specific, nonlimiting example, the average wavelength $\lambda_2$ of the peak-to-peak centerline 147 may be, for example, at least about eight times greater than the average wavelength $\lambda_1$ of the undulating boundary 149. An average amplitude $A_2$ of the peak-to-peak centerline 147 as measured from the plane 124 defined by the average height H of the undulating boundary 149 may be, for example, at least substantially equal to the average amplitude $A_1$ of the undulating boundary 149. In embodiments where the peak-to-peak centerline 147 is undulating, the average wavelength $\lambda_1$ of the undulating boundary 149 may be determined without regard to the wavelength $\lambda_2$ of the peak-to-peak centerline 147 of the undulating boundary 149.

Figure 7:
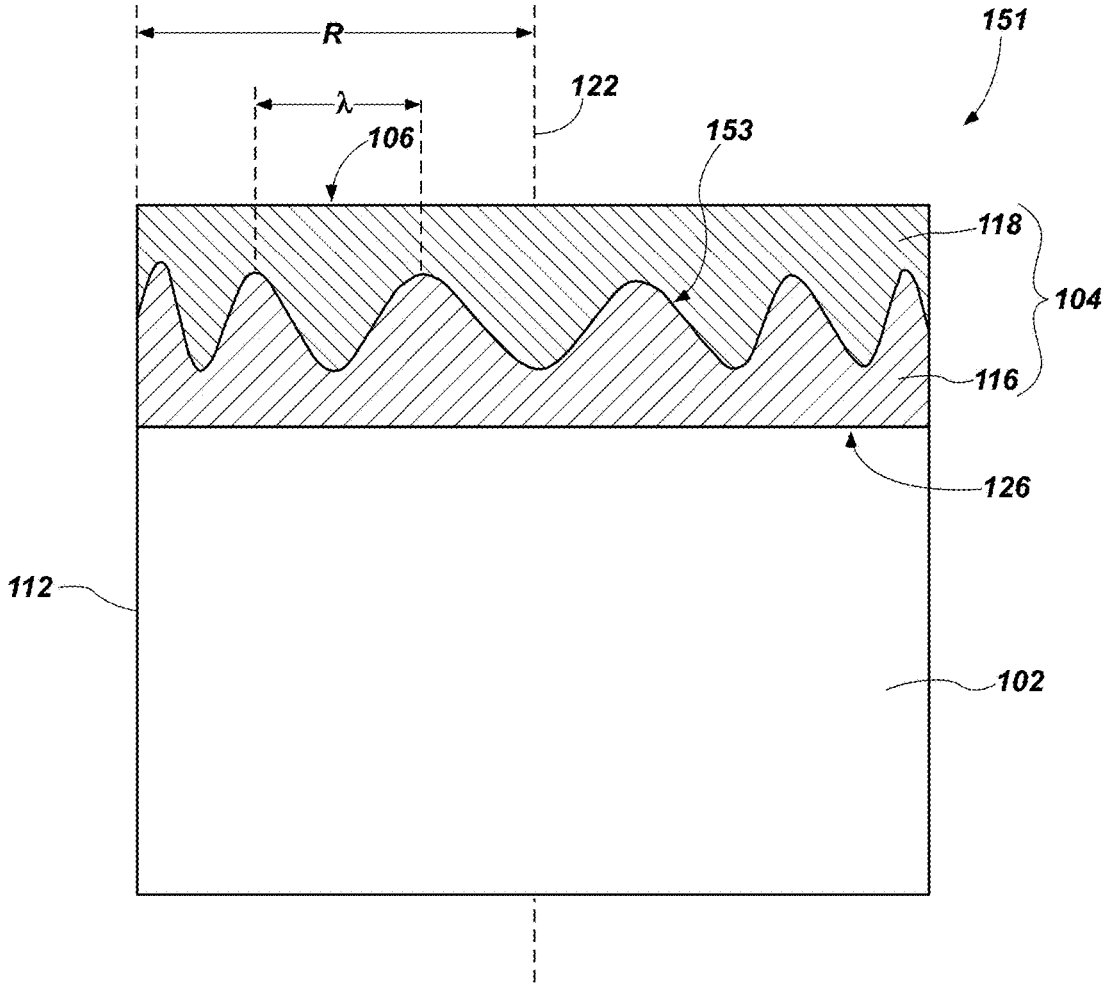
FIG. 7 is a cross-sectional view of still another embodiment of a cutting element.

FIG. 7 is a cross-sectional view of still another embodiment of a cutting element 151. In some embodiments, the wavelength $\lambda$ of an undulating boundary 153 may be smaller proximate the periphery of the cutting element 151 than the wavelength $\lambda$ proximate the longitudinal axis 122. For example, the wavelength $\lambda$ of the undulating boundary 153 may be smaller in a radially outer half of the radius R of the cutting element 151 than the wavelength $\lambda$ in a radially inner half of the radius R. As a specific, nonlimiting example, the wavelength $\lambda$ of the undulating boundary 153 may be smaller in a radially outer third of the radius R of the cutting element 151 than the wavelength $\lambda$ in a radially inner two-thirds of the radius R. In some embodiments, the wavelength $\lambda$ of the undulating boundary 153 may decrease as distance from the longitudinal axis 122 increases. For example, the wavelength $\lambda$ of the undulating boundary 153 may decrease at least substantially continuously as distance from the longitudinal axis 122 increases.

Figure 8:
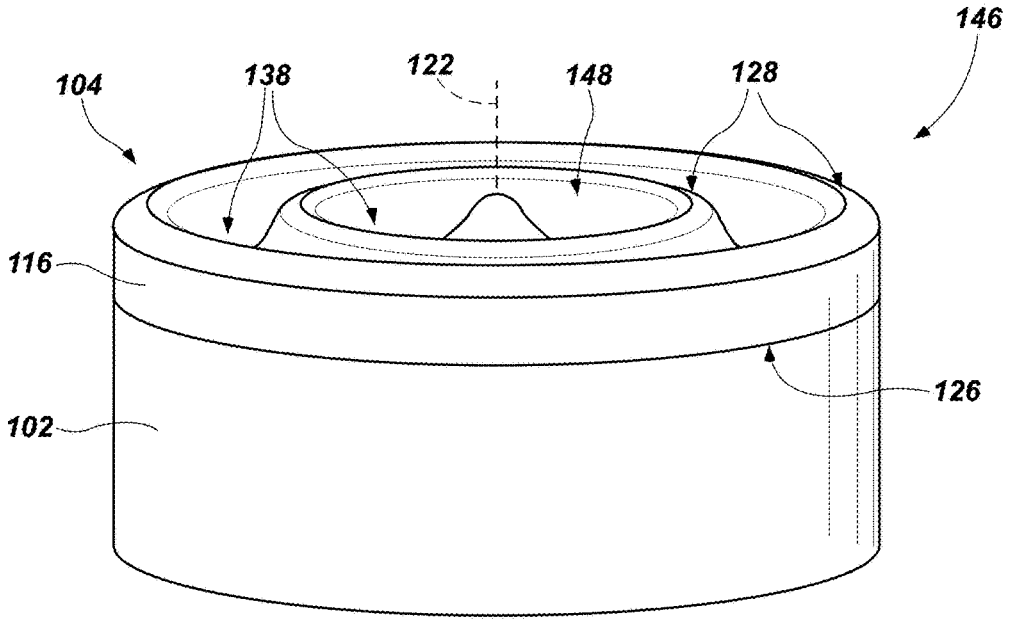
FIG. 8 is a partial cut-away perspective view of yet another embodiment of a cutting element.

FIG. 8 is a partial cut-away perspective view of yet another embodiment of a cutting element 146. In each of FIGS. 8 through 11, the catalyst-free second region 118 has been removed to reveal the various topographies exhibited by the undulating boundaries shown in FIGS. 8 through 11. For example, an undulating boundary 148 between the first region 116 and the second region 118 (see FIGS. 1, 3-7) may exhibit a repeating pattern of concentric circles faulted by crests 128 and troughs 138 of waves encircling the longitudinal axis 122 of the cutting element 146, as shown in FIG. 8.

Figure 9:
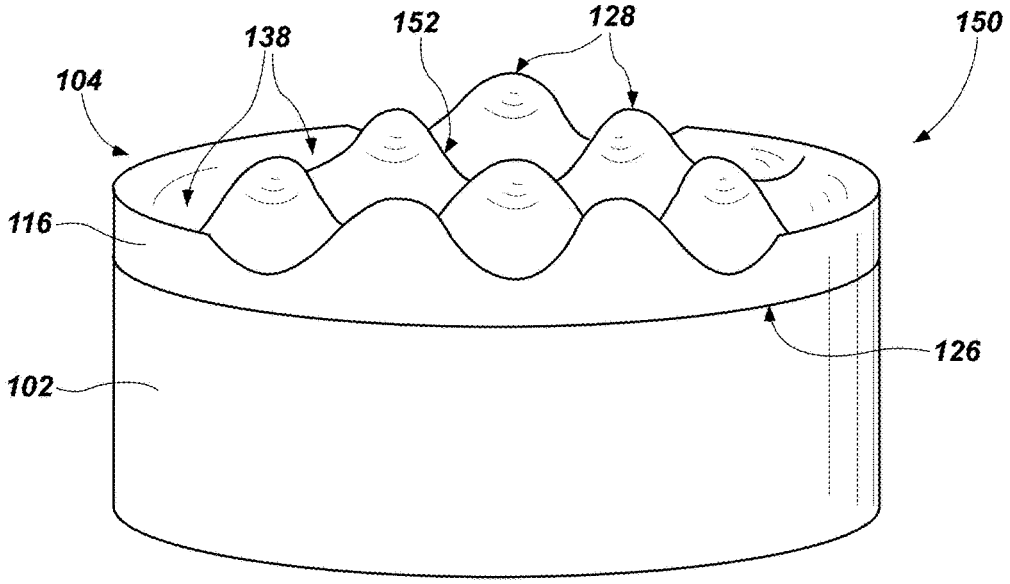
FIG. 9 is a partial cut-away perspective view of still another embodiment of a cutting element.

FIG. 9 is a partial cut-away perspective view of still another embodiment of a cutting element 150 is shown. In some embodiments, an undulating boundary 152 between the first region 116 and the second region 118 (see FIGS. 1, 3-7) may be defined by a repeating pattern of bumps and dimples formed by crests 128 and troughs 138 of phase-shifted waves extending laterally across the cutting element 150, as shown in FIG. 9. In some embodiments, the bumps and dimples may define a uniform pattern. In other embodiments, the bumps and dimples may be randomly oriented and positioned in a nonuniform manner.

Figure 10:
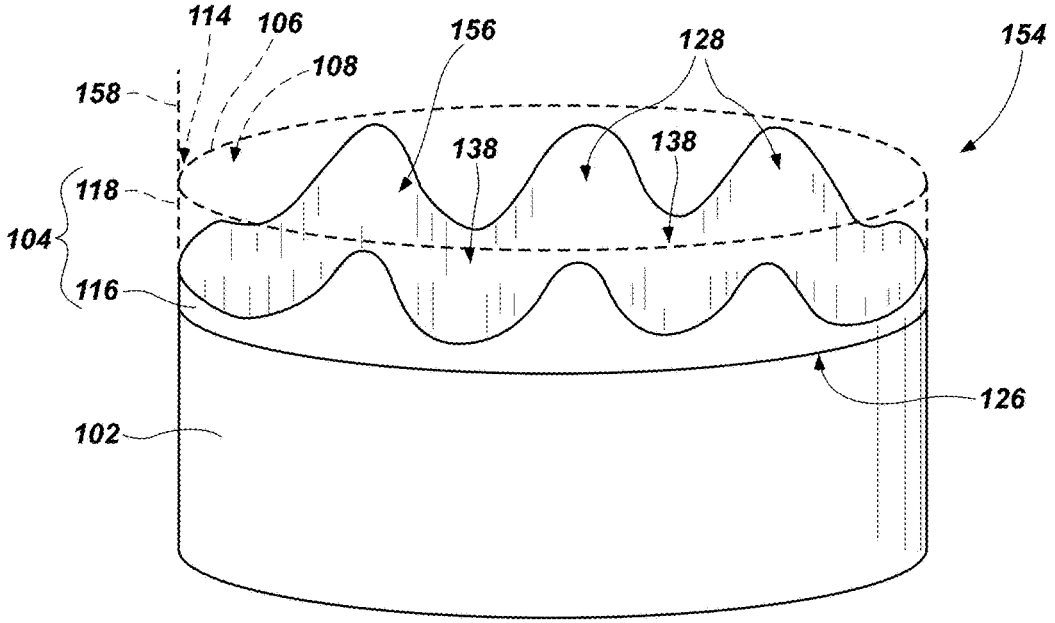
FIG. 10 is a partial cut-away perspective view of another embodiment of a cutting element.

FIG. 10 is a partial cut-away perspective view of another embodiment of a cutting element 154. In FIG. 10, the catalyst-free second region 118 has been shown in dashed lines for the sake of clarity. In some embodiments, and as shown in FIG. 10, an undulating boundary 156 between the first region 116 and the second region 118 exhibits a repeating pattern of crests 128 and troughs 138 of a wave defined by a surface projection of a sine wave, the surface projecting in a direction at least substantially parallel to a line 158 tangent to an intended cutting point 114 on a cutting edge 108 at a periphery of the cutting face 106.

Figure 11:
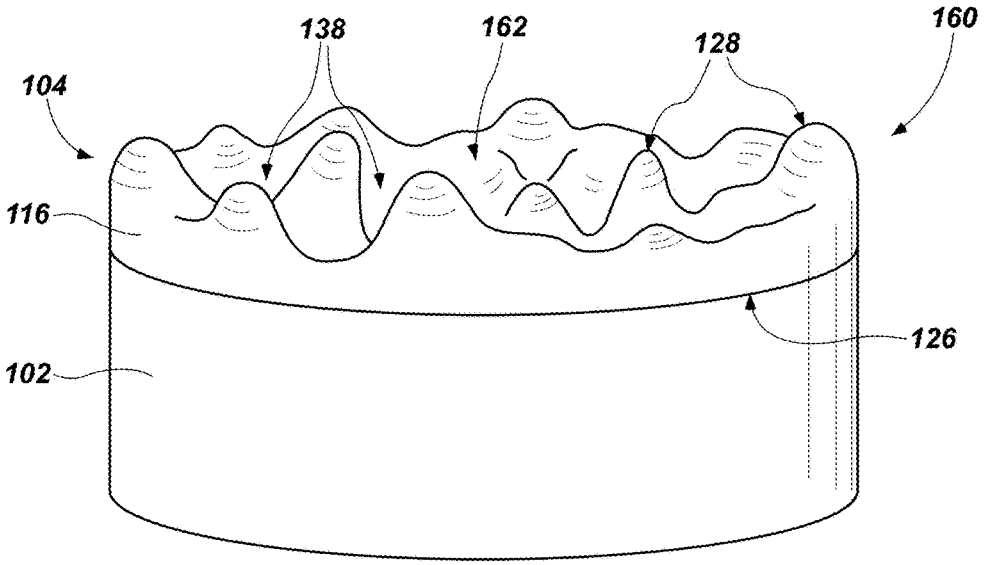
FIG. 11 is a partial cut-away perspective view of yet another embodiment of a cutting element.

FIG. 11 is a partial cut-away perspective view of yet another embodiment of a cutting element 160. In some embodiments, an undulating boundary 162 between the first region 116 and the second region 118 (see FIGS. 1, 3-7) may exhibit an irregular, random topography, defining a tortuous, irregular border.

Figure 12:
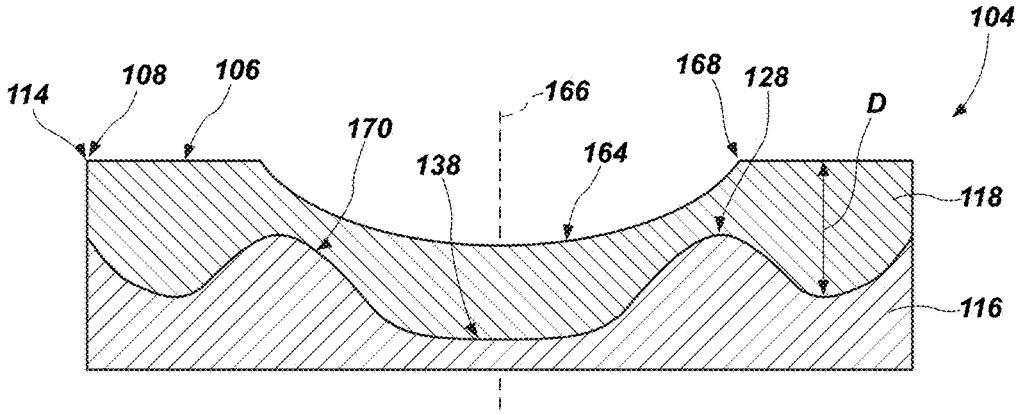
FIG. 12 is a cross-sectional view of another embodiment of a polycrystalline superabrasive material of a cutting element.

FIG. 12 is a cross-sectional view of another embodiment of a polycrystalline superabrasive material 104 for a cutting element. In some embodiments, the polycrystalline superabrasive material 104 may include a concavity 164 proximate a longitudinal axis 166 of the polycrystalline superabrasive material 104, which may be positioned and oriented to align with the longitudinal axis 122 (see FIGS. 1, 4, 5-7) of the cutting element. For example, an exposed, upper surface of the polycrystalline superabrasive material 104 may be defined by a planar cutting face 106 at a periphery of the polycrystalline superabrasive material 104 and a concavity 164 exhibiting an inverse-spherical shape at a radially central portion of the polycrystalline superabrasive material 104. In some embodiments, a depth D of removal of catalyst material with respect to the exposed upper surface of the polycrystalline superabrasive material 104, including the cutting face 106 and the concavity 164, may be greater proximate the longitudinal axis 122 than proximate an intersection 168 between the cutting face 106 and the concavity 164 and greater than proximate the periphery of the polycrystalline superabrasive material 104.

Figure 13:
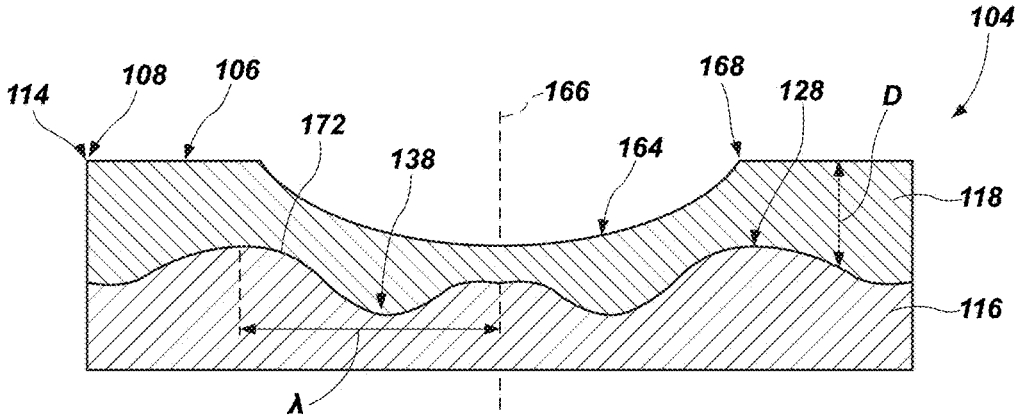
FIG. 13 is a cross-sectional view of yet another embodiment of a polycrystalline superabrasive material of a cutting element.

FIG. 13 is a cross-sectional view of yet another embodiment of a polycrystalline superabrasive material 104 for a cutting element. In some embodiments, the depth D of removal of catalyst material with respect to the exposed upper surface of the polycrystalline superabrasive material 104, including the cutting face 106 and the concavity 164, may be at least substantially the same proximate the longitudinal axis 122 when compared to proximate an intersection 168 between the cutting face 106 and the concavity 164 and less than proximate the periphery of the polycrystalline superabrasive material 104. For example, an undulating boundary 172 may be phase-shifted with respect to other embodiments in which an undulating boundary 170 (see FIG. 10) may be at or near a trough 138 at the longitudinal axis 166 of the polycrystalline superabrasive material 104.

Figure 14:
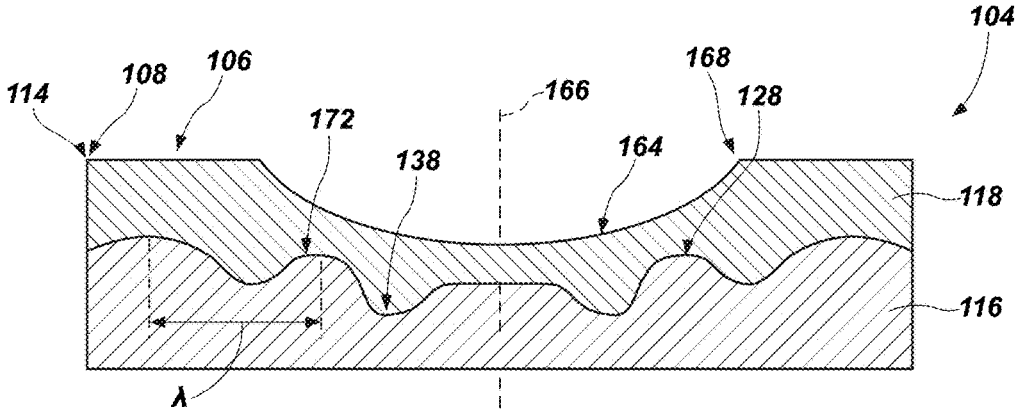
FIG. 14 is a cross-sectional view of still another embodiment of a polycrystalline superabrasive material of a cutting element.

FIG. 14 is a cross-sectional view of still another embodiment of a polycrystalline superabrasive material 104 for a cutting element. In some embodiments, the depth D of removal of catalyst material with respect to the exposed upper surface of the polycrystalline superabrasive material 104, including the cutting face 106 and the concavity 164, may be at least substantially the same proximate the longitudinal axis 122 when compared to proximate an intersection 168 between the cutting face 106 and the concavity 164 and at least substantially the same when compared to proximate the periphery of the polycrystalline superabrasive material 104. For example, the undulating boundary 172 may exhibit a shorter wavelength $\lambda$ with respect to other embodiments, such as that shown in FIG. 13.

When forming an undulating boundary between a catalyst-containing region and a catalyst-free region of a polycrystalline superabrasive material for a cutting element according to any of the embodiments described and shown in connection with this disclosure, catalyst material may be retained within interstitial spaces among interbonded grains in a first region of a polycrystalline superabrasive material secured to a substrate. Catalyst material may be at least substantially completely removed from interstitial spaces among interbonded grains in a second region of the polycrystalline superabrasive material, such that an undulating boundary defined between the first region and the second region extends from a longitudinal axis of the cutting element to a periphery of the cutting element. Catalyst material may be selectively removed from certain portions of the polycrystalline superabrasive material to define the undulating boundary by, for example, targeted laser, ion, or focused particle beam removal of the catalyst material to differing depths or by selective masking and leaching of different portions of the polycrystalline superabrasive material. More specifically, locations on a polycrystalline superabrasive material corresponding to crests of the undulating boundary may be covered with a protective material, and a catalyst-removal agent may leach catalyst material from exposed portions of the polycrystalline superabrasive material to at least partially define troughs of the undulating boundary. After partially defining the undulating boundary, the polycrystalline superabrasive material may be subjected to additional, incremental mask-and-remove processes to selectively remove catalyst material and define the undulating boundary. Additional detail regarding processes for selectively removing catalyst material to different depths within a polycrystalline superabrasive material is disclosed in U.S. patent application Ser. No. 13/947,723, filed Jul. 22, 2013, now U.S. Pat. No. 9,534,450, issued Jan. 3, 2017, titled "THERMALLY STABLE POLYCRYSTALLINE COMPACTS FOR REDUCED SPALLING EARTH-BORING TOOLS INCLUDING SUCH COMPACTS, AND RELATED METHODS," the disclosure of which is incorporated in this application in its entirety by this reference.

Figure 15:
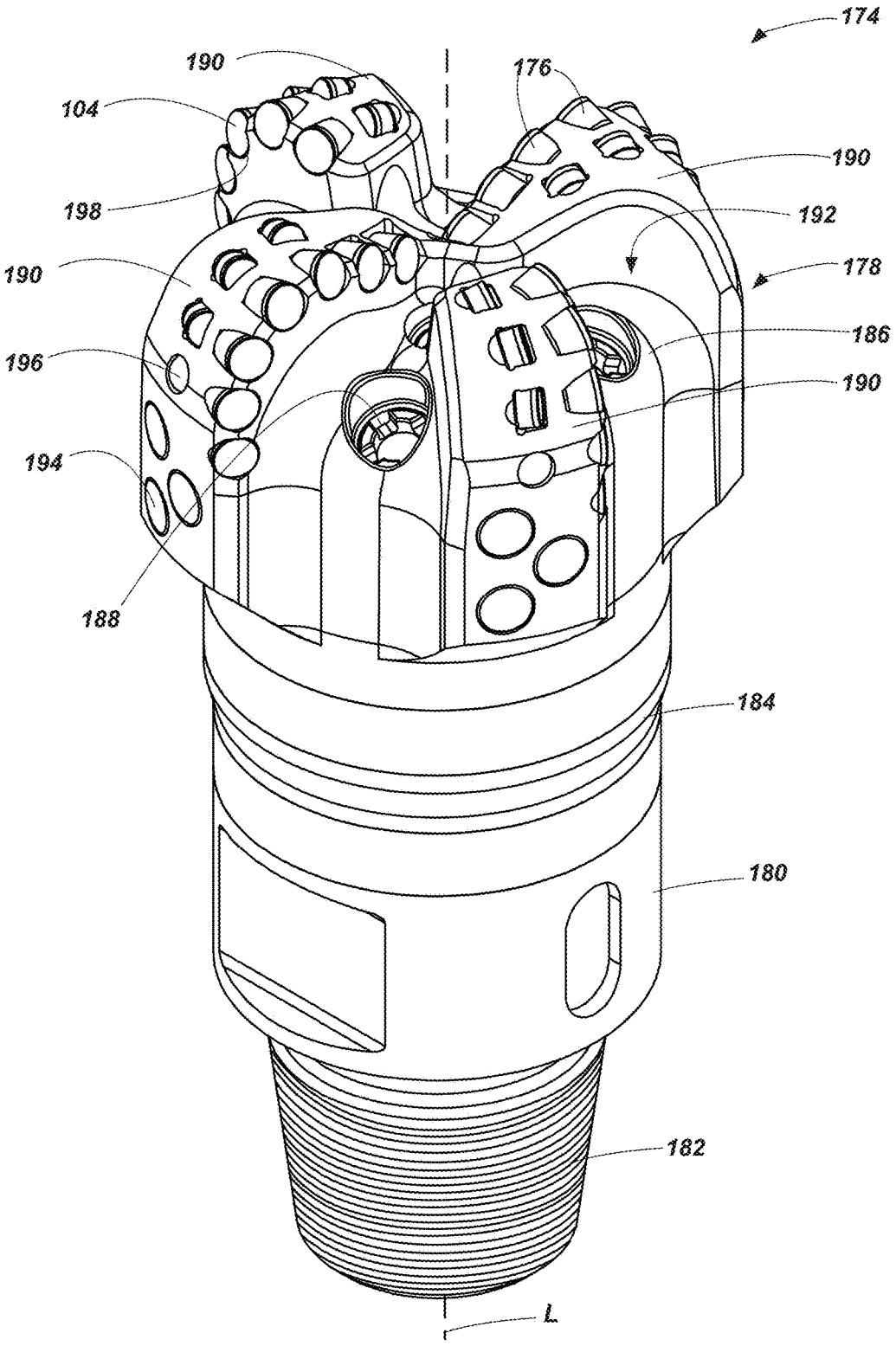
FIG. 15 is a perspective view of an earth-boring tool.

FIG. 15 is a perspective view of an earth-boring tool 174 including cutting elements 176 including undulating boundaries between catalyst containing regions and catalyst-free regions of polycrystalline superabrasive materials 104, such as those shown in FIGS. 1 and 4 through 14, although the earth-boring tool 174 may include cutting elements lacking such undulating boundaries in additional embodiments. The earth-boring rotary tool 174 may include a body 178 secured to a shank 180 having a threaded connection portion 182 (e.g., an American Petroleum Institute (API) threaded connection portion) for attaching the earth-boring tool 174 to a drill string (not shown). In some embodiments, such as that shown in FIG. 15, the body 178 may be formed from a particle-matrix composite material, and may be secured to the metal shank 180 using an extension 184. In other embodiments, the body 178 may be secured to the shank 180 using a metal blank embedded within the particle-matrix composite body 178, or the body 178 may be secured directly to the shank 180.

The body 178 may include internal fluid passageways extending between a face 186 of the body 178 and a longitudinal bore, which may extend through the shank 180, the extension 184, and partially through the body 178. Nozzle inserts 188 also may be provided at the face 186 of the body 178 within the internal fluid passageways. The body 178 may further include blades 190 extending away from a remainder of the body 178, which blades 190 may be angularly separated by junk slots 192 located rotationally between the blades 190. In some embodiments, the body 178 may include gage wear plugs 194 and wear knots 196. Cutting elements 176, which may be as previously described and shown in any of the embodiments within the scope of this application, may be mounted on the face 186 of the body 178 in cutting element pockets 198 located along radially leading portions of each of the blades 190. The cutting elements 176 may be positioned to cut a subterranean formation being drilled while the earth-boring tool 174 is rotated under load (e.g., under weight-on-bit (WOB)) in a borehole about a longitudinal axis L (e.g., an axis of rotation).

Additional non-limiting example embodiments within the scope of this disclosure include the following:

Embodiment 1

A cutting element for an earth-boring tool, comprising: a substrate; and a polycrystalline superabrasive material secured to the substrate, the polycrystalline superabrasive material comprising: a first region including catalyst material in interstitial spaces among interbonded grains of the polycrystalline superabrasive material; and a second region at least substantially free of catalyst material in the interstitial spaces among the interbonded grains of the polycrystalline superabrasive material, an undulating boundary extending from a longitudinal axis of the cutting element to a periphery of the cutting element being defined between the first region and the second region.

Embodiment 2

The cutting element of Embodiment 1, wherein a plane defined by an average height of the undulating boundary with respect to a plane of an interface surface between the substrate and the polycrystalline superabrasive material is at least substantially parallel to the plane of the interface surface.

Embodiment 3

The cutting element of Embodiment 2, wherein the undulating boundary between the first region and the second region exhibits a repeating pattern of concentric circles formed by crests and troughs of waves encircling from the longitudinal axis of the cutting element.

Embodiment 4

The cutting element of Embodiment 2, wherein the undulating boundary between the first region and the second region comprises bumps and dimples formed by crests and troughs of phase-shifted waves.

Embodiment 5

The cutting element of Embodiment 2, wherein the undulating boundary between the first region and the second region exhibits a repeating pattern of crests and troughs of a wave defined by a surface projection of a sine wave, the surface projecting in a direction at least substantially parallel to a line tangent to an intended cutting point on a cutting edge at a periphery of the cutting face.

Embodiment 6

The cutting element of any one of Embodiments 1 through 5, wherein a slope of the undulating boundary at each first point defined by the undulating boundary is different from the slope of the undulating boundary at each adjacent point defined by the undulating boundary, each adjacent point being located about one-fourth of an average wavelength or less from each first point.

Embodiment 7

The cutting element of any one of Embodiments 1 through 6, wherein at least one cross-section of the undulating boundary is sinusoidal.

Embodiment 8

The cutting element of any one of Embodiments 1 through 7, wherein a portion of the polycrystalline superabrasive material in the second region is in a compressive stress state.

Embodiment 9

The cutting element of Embodiment 8, wherein the portion of the polycrystalline superabrasive material in the compressive stress state is located between peaks of the undulating boundary.

Embodiment 10

The cutting element of any one of Embodiments 1 through 9, wherein the undulating boundary comprises waves exhibiting an average amplitude of about 50 μm or less and an average wavelength of about 100 μm or less.

Embodiment 11

The cutting element of any one of Embodiments 1 through 10, wherein the polycrystalline superabrasive material comprises a concavity proximate the longitudinal axis of the cutting element.

Embodiment 12

An earth-boring tool, comprising: a body; and a cutting element secured to the body, the cutting element comprising: a substrate secured to the body; and a polycrystalline superabrasive material secured to the substrate, the polycrystalline superabrasive material comprising: a first region including catalyst material in interstitial spaces among interbonded grains of the polycrystalline superabrasive material; and a second region at least substantially free of catalyst material in the interstitial spaces among the interbonded grains of the polycrystalline superabrasive material, an undulating boundary extending from a longitudinal axis of the cutting element to a periphery of the cutting element being defined between the first region and the second region.

Embodiment 13

A method of preparing a cutting element for an earth-boring tool, comprising: retaining catalyst material within interstitial spaces among interbonded grains in a first region of a polycrystalline superabrasive material, the polycrystalline superabrasive material being secured to a substrate; and at least substantially completely removing catalyst material from interstitial spaces among interbonded grains in a second region of the polycrystalline superabrasive material, an undulating boundary extending from a longitudinal axis of the cutting element to a periphery of the cutting element being defined between the first region and the second region.

Embodiment 14

The method of Embodiment 13, wherein at least substantially completely removing catalyst material from the interstitial spaces among the interbonded grains in the second region of the polycrystalline superabrasive material comprises rendering a plane defined by an average height of the undulating boundary with respect to a plane of a surface of the substrate adjacent to the polycrystalline superabrasive material is at least substantially parallel to the plane of the surface of the substrate adjacent to the polycrystalline superabrasive material.

Embodiment 15

The method of Embodiment 14, wherein at least substantially completely removing catalyst material from the interstitial spaces among the interbonded grains in the second region of the polycrystalline superabrasive material comprises rendering the undulating boundary between the first region and the second region in a repeating pattern of concentric circles formed by crests and troughs of waves radiating outward from the longitudinal axis of the cutting element.

Embodiment 16

The method of Embodiment 14, wherein at least substantially completely removing catalyst material from the interstitial spaces among the interbonded grains in the second region of the polycrystalline superabrasive material comprises rendering the undulating boundary between the first region and the second region in a repeating pattern of bumps and dimples formed by crests and troughs of phase-shifted waves.

Embodiment 17

The method of Embodiment 14, wherein at least substantially completely removing catalyst material from the interstitial spaces among the interbonded grains in the second region of the polycrystalline superabrasive material comprises rendering the undulating boundary between the first region and the second region in a repeating pattern of crests and troughs of a wave defined by a surface projection of a sine wave, the surface projecting in a direction at least substantially parallel to a line tangent to an intended cutting point on a cutting edge at a periphery of the cutting face.

Embodiment 18

The method of any one Embodiments 13 through 17, wherein at least substantially completely removing catalyst material from the interstitial spaces among the interbonded grains in the second region of the polycrystalline superabrasive material comprises rendering at least one cross-section of the undulating boundary sinusoidal.

Embodiment 19

The method of any one of Embodiments 13 through 18, wherein at least substantially completely removing catalyst material from the interstitial spaces among the interbonded grains in the second region of the polycrystalline superabrasive material comprises inducing a compressive residual stress in a portion of the polycrystalline superabrasive material in the second region.

Embodiment 20

The method of any one of Embodiments 13 through 19, wherein at least substantially completely removing catalyst material from the interstitial spaces among the interbonded grains in the second region of the polycrystalline superabrasive material comprises rendering an average amplitude of waves of the undulating boundary to be about 50 μm or less and an average wavelength of the waves of the undulating boundary to be about 100 μm or less.

Embodiment 21

The method of any one of Embodiments 13 through 19, further comprising selecting the polycrystalline superabrasive material to comprise a concavity proximate the longitudinal axis of the cutting element.

While certain illustrative embodiments have been described in connection with the figures, those of ordinary skill in the art will recognize and appreciate that the scope of this disclosure is not limited to those embodiments explicitly shown and described in this disclosure. Rather, many additions, deletions, and modifications to the embodiments described in this disclosure may be made to produce embodiments within the scope of this disclosure, such as those hereinafter claimed, including legal equivalents. In addition, features from one disclosed embodiment may be combined with features of another disclosed embodiment while still being within the scope of this disclosure, as contemplated by the inventors.

What is claimed is:

1. A cutting element for an earth-boring tool, comprising:
a substrate; and
a polycrystalline superabrasive material secured to the substrate, the polycrystalline superabrasive material comprising:
a first region including catalyst material in interstitial spaces among interbonded grains of the polycrystalline superabrasive material; and
a second region at least substantially free of catalyst material in the interstitial spaces among the interbonded grains of the polycrystalline superabrasive material, an undulating boundary comprising bumps and dimples formed by crests and troughs of phase-shifted waves extending from a longitudinal axis of the cutting element to a periphery of the cutting element being defined between the first region and the second region.

2. The cutting element of claim 1, wherein a plane defined by an average height of the undulating boundary with respect to a plane of an interface surface between the substrate and the polycrystalline superabrasive material is at least substantially parallel to the plane of the interface surface.

3. The cutting element of claim 1, wherein a slope of the undulating boundary at each first point defined by the undulating boundary is different from the slope of the undulating boundary at each adjacent point defined by the undulating boundary, each adjacent point being located about one-fourth of an average wavelength or less from each first point.

4. The cutting element of claim 1, wherein at least one cross-section of the undulating boundary is sinusoidal.

5. The cutting element of claim 1, wherein a portion of the polycrystalline superabrasive material in the second region is in a compressive stress state.

6. The cutting element of claim 5, wherein the portion of the polycrystalline superabrasive material in the compressive stress state is located between peaks of the undulating boundary.

7. The cutting element of claim 1, wherein the undulating boundary comprises waves exhibiting an average amplitude of between about 40 μm and 50 μm and an average wavelength of between about 100 μm and about 1000 μm.

8. The cutting element of claim 1, wherein the polycrystalline superabrasive material comprises a concavity proximate the longitudinal axis of the cutting element.

9. An earth-boring tool, comprising:
a body; and
a cutting element secured to the body, the cutting element comprising:
a substrate secured to the body; and a polycrystalline superabrasive material secured to the substrate, the polycrystalline superabrasive material comprising:

a first region including catalyst material in interstitial spaces among interbonded grains of the polycrystalline superabrasive material; and a second region at least substantially free of catalyst material in the interstitial spaces among the interbonded grains of the polycrystalline superabrasive material, an undulating boundary comprising bumps and dimples formed by crests and troughs of phase-shifted waves extending from a longitudinal axis of the cutting element to a periphery of the cutting element being defined between the first region and the second region.

10. The earth-boring tool of claim 9, wherein a plane defined by an average height of the undulating boundary with respect to a plane of an interface surface between the substrate and the polycrystalline superabrasive material is at least substantially parallel to the plane of the interface surface.

11. The earth-boring tool of claim 9, wherein a slope of the undulating boundary at each first point defined by the undulating boundary is different from the slope of the undulating boundary at each adjacent point defined by the undulating boundary, each adjacent point being located about one-fourth of an average wavelength or less from each first point.

12. The earth-boring tool of claim 9, wherein at least one cross-section of the undulating boundary is sinusoidal.

13. The earth-boring tool of claim 9, wherein the undulating boundary comprises waves exhibiting an average amplitude of between about 40 μm and 50 μm and an average wavelength of between about 100 μm and about 1000 μm.

14. The earth-boring tool of claim 9, wherein the polycrystalline superabrasive material comprises a concavity proximate the longitudinal axis of the cutting element.

15. A method of preparing a cutting element for an earth-boring tool, comprising:

retaining catalyst material within interstitial spaces among interbonded grains in a first region of a polycrystalline superabrasive material, the polycrystalline superabrasive material being secured to a substrate; and at least substantially completely removing catalyst material from interstitial spaces among interbonded grains in a second region of the polycrystalline superabrasive material, to form an undulating boundary comprising bumps and dimples formed by crests and troughs of phase-shifted waves extending from a longitudinal axis of the cutting element to a periphery of the cutting element between the first region and the second region.

16. The method of claim 15, wherein at least substantially completely removing catalyst material from the interstitial spaces among the interbonded grains in the second region of the polycrystalline superabrasive material comprises rendering a plane defined by an average height of the undulating boundary with respect to a plane of a surface of the substrate adjacent to the polycrystalline superabrasive material at least substantially parallel to the plane of the surface of the substrate adjacent to the polycrystalline superabrasive material.

17. The method of claim 15, wherein at least substantially completely removing catalyst material from the interstitial spaces among the interbonded grains in the second region of the polycrystalline superabrasive material comprises rendering at least one cross-section of the undulating boundary sinusoidal.

18. The method of claim 15, wherein at least substantially completely removing catalyst material from the interstitial spaces among the interbonded grains in the second region of the polycrystalline superabrasive material comprises inducing a compressive residual stress in a portion of the polycrystalline superabrasive material in the second region.

19. The method of claim 15, wherein at least substantially completely removing catalyst material from the interstitial spaces among the interbonded grains in the second region of the polycrystalline superabrasive material comprises rendering an average amplitude of waves of the undulating boundary to be between about 40 μm and about 50 μm and an average wavelength of the waves of the undulating boundary to be between about 100 μm and about 1000 μm.

20. The method of claim 15, further comprising forming a concavity in the polycrystalline superabrasive material proximate the longitudinal axis of the cutting element.

* * * * *